US006281770B1

(12) United States Patent
Quentric

(10) Patent No.: US 6,281,770 B1
(45) Date of Patent: Aug. 28, 2001

(54) STARTING SWITCH COMPRISING A FIXED MAGNETIC CORE IN SEVERAL PARTS

(75) Inventor: Jean-François Quentric, St Bonnet de Mure (FR)

(73) Assignee: Valeo Equipments Electriques Moteur, Creteil (FR)

( * ) Notice: Subject to any disclaimer, the term of this patent is extended or adjusted under 35 U.S.C. 154(b) by 0 days.

(21) Appl. No.: 09/530,432

(22) PCT Filed: Sep. 3, 1999

(86) PCT No.: PCT/FR99/02100

§ 371 Date: May 1, 2000

§ 102(e) Date: May 1, 2000

(87) PCT Pub. No.: WO00/14758

PCT Pub. Date: Mar. 16, 2000

(30) Foreign Application Priority Data

Sep. 3, 1998 (FR) ..... 98 11121

(51) Int. Cl.[7] ..... H01H 67/02
(52) U.S. Cl. ..... 335/126; 335/131
(58) Field of Search ..... 335/126, 131

(56) References Cited

U.S. PATENT DOCUMENTS 3,791,684 * 2/1974 Hamman ..... 310/254
3,822,469 7/1974 Lazenby .
4,755,781 * 7/1988 Bogner ..... 335/131
4,819,975 * 4/1989 Morishita et al. ..... 290/48
4,963,849 * 10/1990 Kowalczyk et al. ..... 335/201
5,075,150 * 12/1991 Webb et al. ..... 428/162
5,338,996 * 8/1994 Yamamoto ..... 310/216

FOREIGN PATENT DOCUMENTS 900847 1/1954 (DE) .
2548280 1/1985 (FR) .

* cited by examiner

*Primary Examiner*—Lincoln Donovan
(74) *Attorney, Agent, or Firm*—Liniak, Berenato, Longacre & White

(57) ABSTRACT

A contactor for a motor vehicle starter, of the type that includes a movable magnetic core which is displaced axially under the effect of a magnetic field produced by a coil, and of the type that includes a fixed magnetic core (26) which extends transversely to a front axial end of the coil, of the type in which the fixed core (26) includes a rear base portion (28) which is received axially in the coil and which has an axial through hole (44) to enable a movable contact finger to pass through, and of the type in which the fixed core (26) includes an annular front disc (30) which is assembled to the rear base portion (26), and which is mounted in a cylindrical seating of the contactor, characterised in that the front disc (30) consists of a stack of laminations (32).

4 Claims, 3 Drawing Sheets

STARTING SWITCH COMPRISING A FIXED MAGNETIC CORE IN SEVERAL PARTS

BACKGROUND OF THE INVENTION

1. Field of the Invention

This invention relates to an electromagnetic actuator for a motor vehicle starter head, also referred to as a starter contactor.

More particularly, the invention relates to a contactor for a motor vehicle starter, of the type that includes a movable magnetic core, which is displaced axially under the effect of a magnetic field created by a winding that comprises at least one electrical conductor wound around a body of a coil, and of the type that includes a fixed magnetic core which extends transversely to a front axial end of the winding, of the type in which the fixed core comprises a rear base portion which is received axially in the coil and which includes an axial through hole for passage through it of a movable contact plunger, and of the type in which the fixed core includes an annular front disc, which is assembled to the rear base portion, and which is mounted in a cylindrical seating in the contactor.

2. DESCRIPTION OF RELATED ART

In a known way, the magnetic field produced by the electrical conductor wound around the body of the coil of a contactor follows lines of force which are substantially axial inside the coil, and which are in the form of loops closed on themselves outside the coil.

In a known design, the fixed magnetic coil is generally a piece made of soft iron which ensures continuity of passage for the magnetic flux between the carcass of the starter and the movable core.

Thus the lines of force are closed on themselves in the immediate vicinity of the coil, which enables the output of the electromagnet to be increased and the electrical power consumed by the latter to be reduced.

Generally, fixed magnetic cores used in the manufacture of conventional starters are made in one piece, and are made by a conventional extrusion method.

A major disadvantage of these cores lies in the complexity of their geometrical forms, which makes them expensive to manufacture.

In order to resolve this problem, it has previously been proposed to make fixed magnetic cores in two parts, corresponding respectively to the rear base portion and the front disc of the fixed core. In this type of design, the rear base portion, which is of simple form, is obtained by extrusion or turning or centring, while the front disc is made by stamping out in the press from a thick metal sheet.

However, the thickness of the front disc, which is a constructional feature which is indispensable in order to give satisfactory guidance to the movable contact finger connected to the movable core, is such that its manufacture by a press-forming operation gives low rates of production and requires a high-powered press, which makes manufacture of the front disc an expensive operation.

In order to overcome these drawbacks, the invention proposes a fixed magnetic core of simplified manufacture.

With this in view, the invention proposes a contactor for a motor vehicle starter, of the type that includes a movable magnetic core which is displaced axially under the effect of a magnetic field created by a winding that comprises at least one electrical conductor wound around a body of a coil, and of the type that includes a fixed magnetic core which extends transversely to a front axial end of the winding, of the type in which the fixed core comprises a rear base portion which is received axially in the coil and which includes an axial through hole for passage through it of a movable contact plunger, and of the type in which the fixed core includes an annular front disc, which is assembled to the rear base portion, and which is mounted in a cylindrical seating in the contactor, characterised in that the front disc consists of a stack of laminations.

In accordance with other features of the invention:

- the laminations are thin press-formed laminations;
- the laminations have means for clipping them to each other, and means for connecting them to the rear base portion;
- the means for connecting the laminations to the rear base portion comprise a centring hole formed in each of the laminations, which enables the stack of laminations to be force-fitted on a sleeve portion of the rear base portion;
- the axial length of the sleeve portion is equal to the thickness of the stack of laminations, with the front end of the sleeve portion being flush with the annular front face of the front endmost lamination;
- the stack of laminations has at least one peripheral axial groove, and the front endmost lamination has a radial lug which is formed by stamping close to the periphery of the front endmost lamination, whereby to receive an electrical earth conductor of the coil and, on being bent back, to retain the conductor mechanically on the front endmost lamination;
- the front endmost lamination has at least two fingers formed by stamping, which extend axially forward for fastening an electronic circuit board, especially by welding or brazing;
- the front endmost lamination is tinned so as to facilitate soldering of the electronic circuit board;
- the front endmost lamination has on its edge at least three points which extend radially outwards so as to penetrate the material of the cylindrical seating of a carcass of the contactor, in which the stack is fitted axially so as to ensure electrical contact between the stack of laminations and the carcass.

BRIEF DESCRIPTION OF DRAWINGS

Further features and advantages of the invention will appear on a reading of the following detailed description, for an understanding of which, reference will be made lo the attached drawings, in which.

DETAILED DESCRIPTION OF PREFERRED EMBODIMENTS

Figure 1:
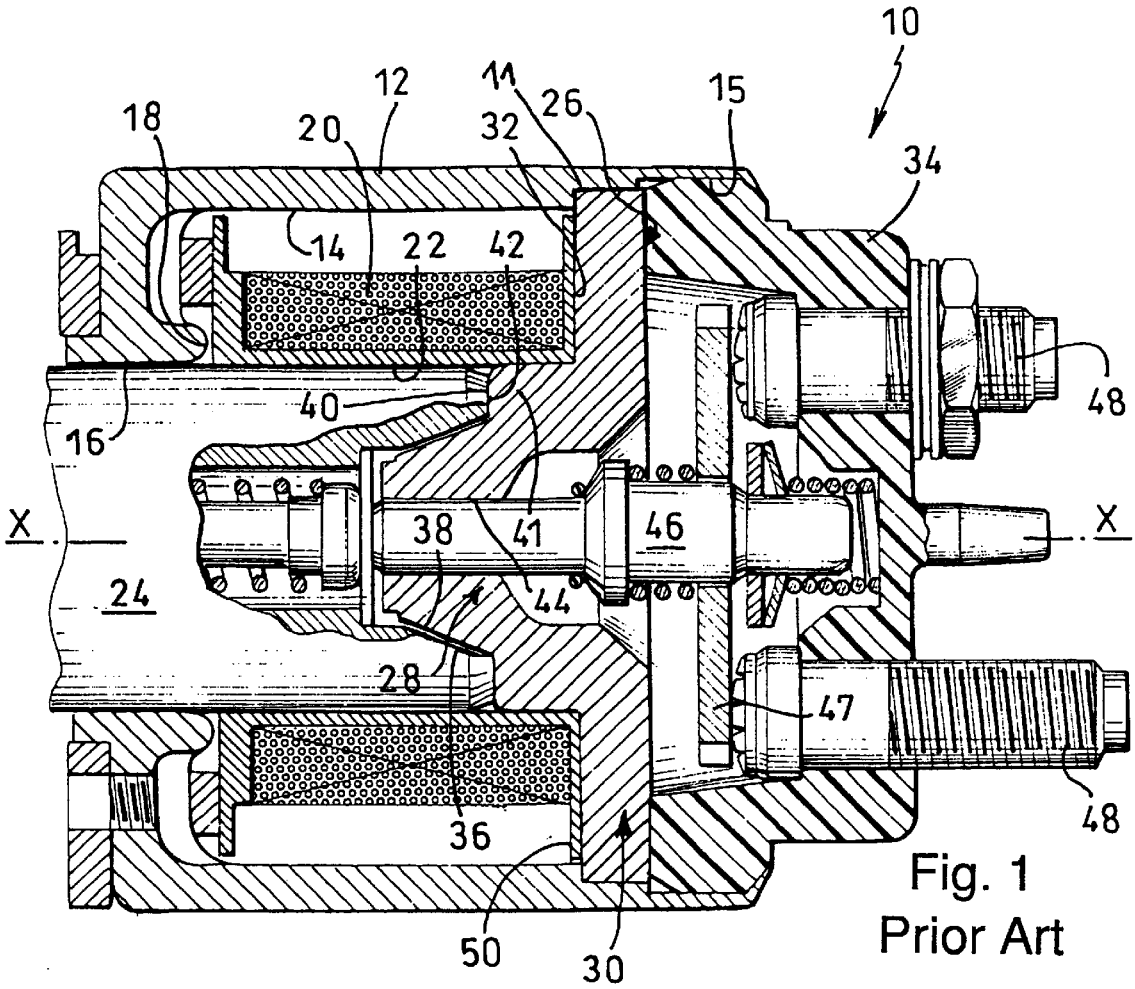
Fig. 1 Prior Art
FIG. 1 is a view in axial cross section of a front part of a contactor, showing a one-piece fixed core in accordance with the state of the art.

In the following description, identical reference numerals are used to designate components which are identical to each other or which have similar functions.

FIG. 1 shows a contactor 10 of a starter (not shown) for a motor vehicle combustion engine.

In the known way, the starter contactor 10 has a carcass 12 which is substantially cylindrical and which includes, going from front to rear, that is to say from right to left, a bore 14 of large diameter and a bore 16 of small diameter. The bore 14 of large diameter includes at its front end a chamfered internal cylindrical surface 15, the function of which will be described later herein. The two bores 14 and 16 are delimited by a shoulder surface 18.

The bore 14 of large diameter receives a coil 20 which is retained against axial movement, along the longitudinal axis X-X of the contactor, by the shoulder surface 18. The coil 20 is substantially cylindrical, and includes an internal bore 22 the diameter of which is substantially equal to that of the internal bore of small diameter 16 in the carcass 12, so that, when the coil 20 is mounted within the carcass 12, the internal bore 22 of the coil 20 is aligned on the axis X-X with the small diameter bore 16 of the carcass 12.

The internal bore 16 of small diameter and the internal bore 22 of the coil receive a magnetic core 24 which is movable in axial sliding motion. The coil 20 and the magnetic core 24 together constitute an electromagnet which is arranged for controlling the operation of the starter of the vehicle.

The details of the operation of the electromagnet and the core are part of the state of the art, and for this reason they will not be described any further in the present description.

As shown in FIG. 1, a fixed magnetic core 26 is arranged at the front axial end of the coil 20.

The fixed magnetic core 26 has a rear base portion 28 which is substantially cylindrical and which is received axially in the internal bore 22 of the coil 20, together with an annular disc 30 which is received in a cylindrical seating 11 which is located in the front end of the internal bore 14 of large diameter and which is formed in the carcass 12. The disc 30 is engaged flat against the front end 32 of the coil 20 by an end cap 34. The end cap 34 is seamed into the chamfered internal cylindrical surface 15 of the carcass 12, and axially closes off the internal bore 14 of large diameter of the carcass 12.

Preferably, the base portion 28 at the rear end comprises, going from the rear towards the front, a rear male frusto-conical surface 36 which is arranged to be received within a complementary female frusto-conical surface 38 of the movable magnetic core, and a cylindrical front body 41, the frusto-conical female portion 38 and the cylindrical body 41 together defining a shoulder surface 40. The shoulder surface 40 is arranged to serve as an abutment for an annular cylindrical face 42 at the front end of the movable magnetic core 24 during its axial displacements. The fixed magnetic core 26 has a central through hole 44 to provide a passage and guidance for a movable contact plunger 46 which is arranged to be controlled in its axial displacements by the axial movements of the movable magnetic core 24, so as to establish, through the contact plate 47 which it carries, an electrical contact between two terminals 48 which are carried by the end cap 34 that closes off the carcass 12.

Details of the operation of the movable electric contact plunger 46 in relation with the terminals 48 of the end cap 34, which are known from the state of the art, will not be elaborated any further in this description.

In addition, the fixed magnetic core 26 is in contact with a metal body 50 of the coil 20. The fixed magnetic core 26 is itself made of a magnetic material, and preferably closes the magnetic circuit of which the coil 20 forms part, so that when a current is flowing through the winding of the coil 20, the field lines within the coil 20 are substantially axial and parallel to the axis X-X.

In the state of the art, the fixed magnetic core is a component made of a magnetic metallic material and is formed integrally as shown in FIG. 1. Conventionally, the fixed magnetic core is made by extrusion, which, having regard to the complex profiles which it has, such as the frusto-conical surface 36, the shoulder surface 40, or again the hole 44 through which the movable contact plunger 46 passes, lead in practice to a component which is relatively expensive to make.

Figure 2:
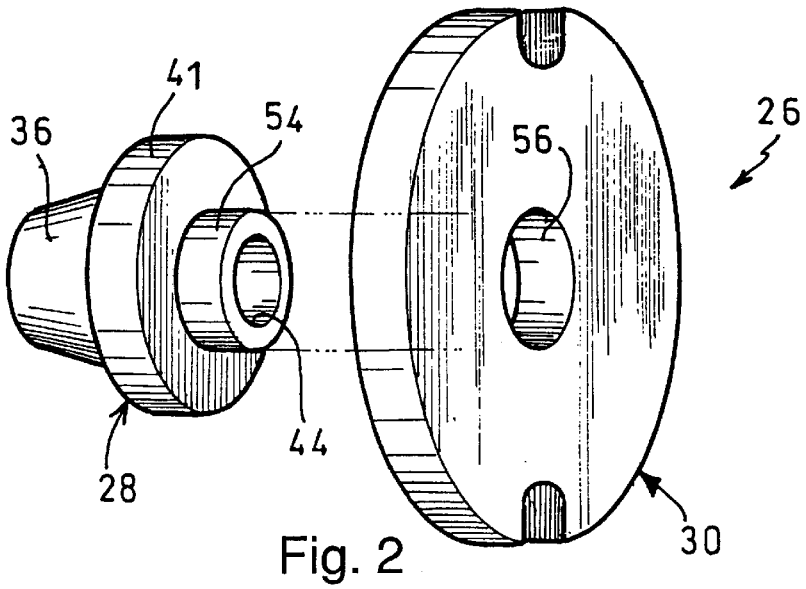
Fig. 2 Prior Art
FIG. 2 is an exploded perspective view of a two-part fixed core in the state of the art.

FIG. 2 shows another arrangement in the state of the art in which the fixed magnetic core 26 is made in two parts, the base portion 28 at the rear end and the front disc 30 being formed separately.

The assembly of the rear base portion 28 and the disc 30 has profiles similar to the fixed magnetic core 26 described above with reference to FIG. 1. The rear base portion 28 includes, going from the rear towards the front, the frusto-conical surface 36, the cylindrical body 41, and a front axial cylindrical sleeve portion 54, the internal diameter of which corresponds to the diameter of the hole 44 described above, with its outer diameter, which is generally smaller than that of the cylindrical body 41, being arranged to provide centring for the front disc 30 since it is received in a hole 56 for centring the front disc 30. In this way, the front disc 30 can be assembled to the rear base 28, to form an assembly which thus constitutes the fixed magnetic core 26.

This design enables a fixed magnetic core 26 to be made in two parts, with the rear base 28 being formed by extrusion or turning or centring, while the front disc 30 is made by press-forming, which substantially reduces the costs of manufacturing a fixed magnetic core 26 as described.

However, the manufacture of the front disc 30 does, because of its thickness, make it necessary to use a hydraulic press of high power, and the press-forming time for such a front disc 30 is long and therefore expensive.

Figure 5:
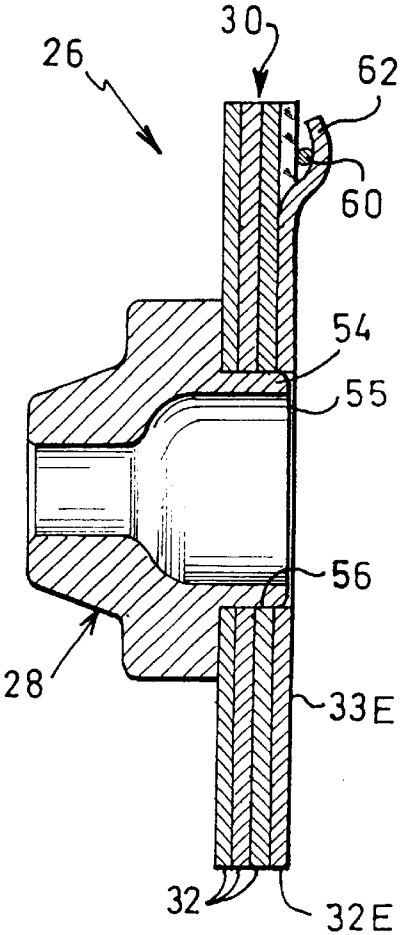
FIG. 5 is a view of the fixed core of FIG. 4, which is shown in axial cross section taken on the plane 5—5 in FIG. 4, in the plane of the radial lug of its front endmost lamination.
Figure 4:
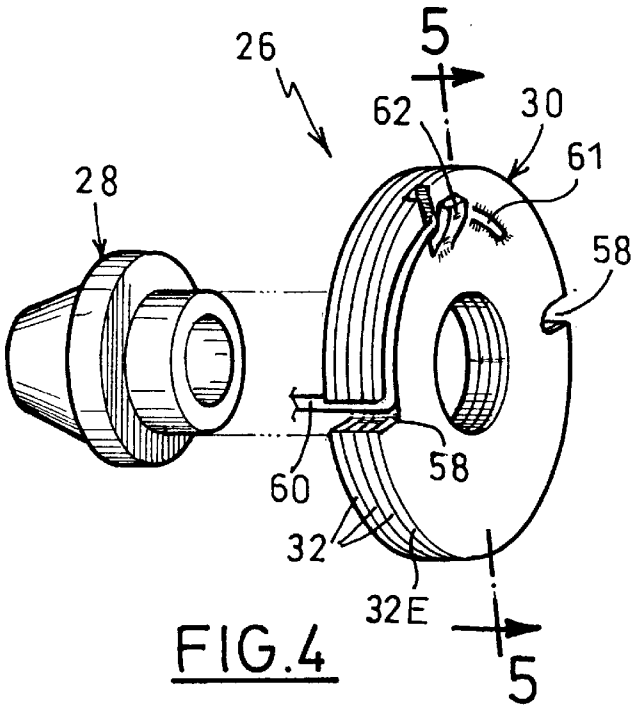
FIG. 4 is an exploded perspective view of the fixed core of FIG. 3.
Figure 3:
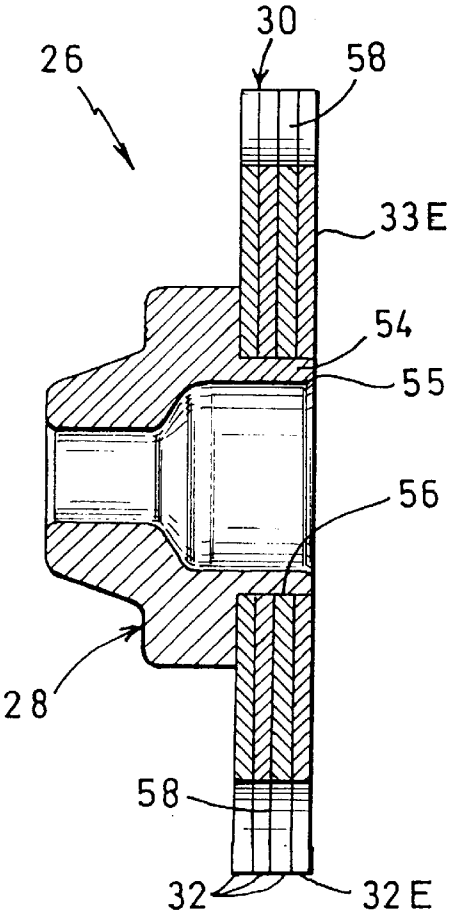
FIG. 3 is a view of a two-part fixed core in a first embodiment of the invention, shown in axial cross section in the plane of its peripheral axial grooves.

In the embodiment shown in FIGS. 3 to 5, the invention provides a remedy for this drawback. As is the case for the fixed magnetic core 26 described with reference to FIG. 2, the two-part fixed magnetic core 26 shown in FIGS. 3 to 5 has a rear base portion 28 identical to that described with reference to FIG. 2.

On the other hand, the front disc 30 consists of an assembly of thin laminations 32, of which there are four in this example and which are stacked together axially, so that the stack constitutes a front disc 30 the form of which is generally similar to that described above with reference to FIG. 2. Each lamination 32 has a centring hole 56, the diameter of which is equal to that of the front disc 30 described above with reference to FIG. 2, and the stack of the laminations 32 has a total thickness which is equal to that of the sleeve portion 54 of the rear base portion 28, so that the front annular end 55 of the sleeve portion 54 is situated in the transverse plane of the front face 33E of the endmost front lamination 32E of the stack.

Each lamination 32 may with advantage be press-formed using a lowpower hydraulic press, with a short process time, which substantially reduces manufacturing costs.

Preferably, the laminations 32 are coupled together, in the rest of this description, by clips (not shown) in such a way as to constitute the front disc 30.

As can be seen in FIGS. 3 and 4, the stack of the laminations 32 which constitute the front disc 30 includes at its periphery two axial grooves 58 diametrically opposed to each other, which are arranged to provide passage for an electrical earth conductor 60 for the coil 20. Preferably, the grooves 58 of the stack of laminations 32 that constitute the front disc 30 are press-formed in the same way in each of the laminations 32.

As can be seen in FIGS. 4 and 5, the front endmost lamination 32E includes on its external face 33E a radial lug 62 which is pressed out, for example by stamping in the front endmost lamination 32E, and which is arranged to be displaced away by bending so as to allow the electrical earth conductor 60 to pass through, being then axially forced back towards the rear so as to hold it in position with respect to the front disc 30. In this way, when the end 61 of the electrical earth conductor 60 is soldered on the front endmost lamination 32E, the radial lug 62 guarantees good mechanical retention of the conductor wire 60 on the front disc 30, while avoiding any application, on the soldered joint of the electrical earth conductor 60, of mechanical stresses which would be liable to be applied to it.

Figure 6:
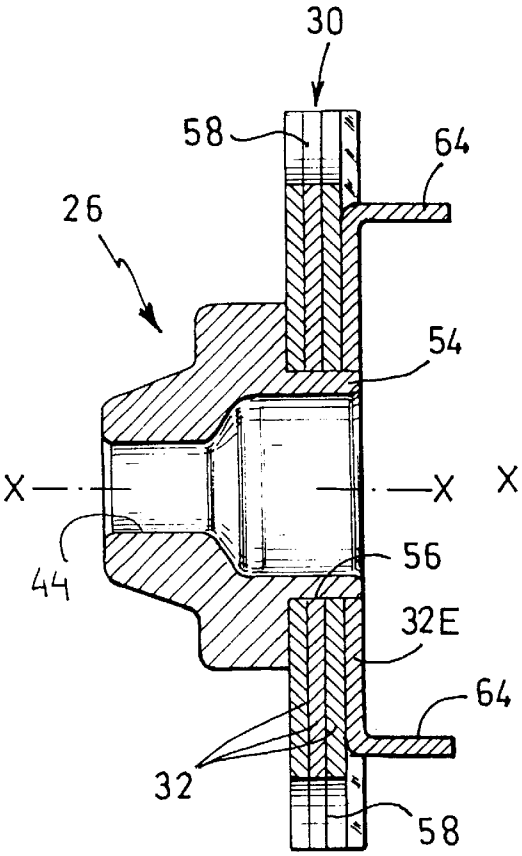
FIG. 6 is a view of a two-part fixed core in a second embodiment of the invention, the front endmost lamination of which is formed with fingers, and which is shown in axial cross section taken on the plane 6—6 in FIG. 7.

FIG. 6 shows a second embodiment of the invention, in which the endmost front lamination 32E of the assembly of laminations, constituting the front disc 30, includes fingers 64 which are orientated substantially axially and which are directed forward, so as to enable an electronic circuit board 66 to be fastened by soldering or brazing. At least two of the fingers 64 are provided, so as to guarantee sound fastening of the electronic circuit board 66, but this choice is not restricting and there may be more.

Manufacture of the fixed magnetic core 26 is similar to that of the fixed magnetic core 26 described above with reference to FIGS. 3 to 5, with the fingers 64 being formed in the same way as the radial lug 62 described above, that is to say being cut out, for example by stamping, close to the periphery of the endmost lamination 32E, and then bent back at right angles to the latter in the axial direction X-X, so that they extend forward from the endmost lamination 32E which can then be clipped to the other laminations 32.

Figure 7:
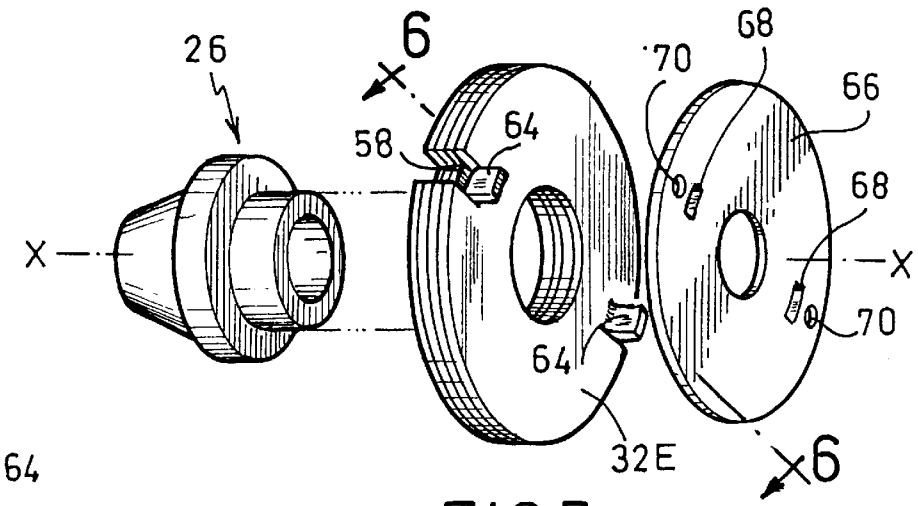
FIG. 7 is an exploded perspective view of the fixed core of FIG. 6, together with an associated electronic circuit board.

As can be seen in FIG. 7, the electronic circuit board 66 associated with the fingers 64 has two through holes 68, which are substantially rectangular and diametrically opposed to each other, and which are arranged for the fingers 64 to pass through them so that the latter are soldered on the electronic circuit board 66. Preferably, the endmost lamination 32E is tinned during the operation of making the fixed magnetic core 26, so as to facilitate soldering of the electronic circuit board 66 on the fingers 64.

In addition, in the preferred embodiment of the invention, the fingers 64 of the front endmost lamination 32E are aligned radially with the groove 58 formed in the stack of laminations 32, while the electronic circuit board 66 has two through holes 70, diametrically opposed to each other and aligned with the through holes 68, so as to enable the earth conductor 60 of the core, described above, to pass through.

Thus, the earth conductor 60 of the core can consequently be soldered directly on the electronic circuit board 66, and this is advantageous.

Figure 8:
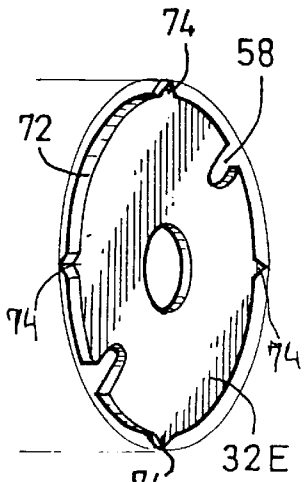
FIG. 8 is a perspective view of a front endmost lamination formed with points in a third embodiment of the invention.

Finally, as is shown in FIG. 8, a third embodiment of the invention includes a magnetic core the construction of which is generally similar to the foregoing, and which comprises a lamination 32E, the edge 72 of which includes four points 74 which are adapted to penetrate the cylindrical seating 11 of the carcass 12 described above with reference to FIG. 1. Preferably, and in the preferred version of the invention, there are four of these points, but it is enough that the lamination 32E has at least three of them, and that they are spaced apart at regular angular intervals.

Thus, when the stack of laminations 32 constituting the front disc 30 is received in the internal bore 14 of large diameter of the carcass 12, the points 74 penetrate radially outwards into the material of the carcass 12, thus ensuring satisfactory electrical earth contact between the fixed magnetic core 26 and the carcass 12 of the core.

Preferably, the use of a stack of thin laminations enables functional profiles, such as the grooves 58, the fingers 64 and the points 74, to be formed by an easy manufacturing method, which leads to a substantially decrease in production costs.

What is claimed is:

1. A contactor (10) for a motor vehicle starter comprising a carcass (12) having a front end provided with a cylindrical seating (11), a coil (20) mounted within the carcass (12) and having a front axial end, a movable magnetic core (24) which is displaced axially under the effect of a magnetic field created by the coil (20), a fixed magnetic core (26) arranged at the front axial end of the coil (20) and having, on the one hand, a rear base portion (28) which is received axially in the coil (20) and which includes an axial through hole (44) for passage through it of a movable contact plunger (46), and, on the other hand, an annular front disc (30) which is assembled to the rear base portion (28) and which is mounted in the cylindrical seating (11) of the carcass (12), said front disc (30) consisting of a stack of laminations (32) having at least a rear endmost lamination (32) adjacent to the rear base portion (28) and a front endmost lamination (32E), wherein the coil (20) has an electrical earth conductor (60), in that the stack of lamination has at least one peripheral axial groove (58) to provide passage for said electrical earth conductor (60) and in that the front endmost lamination (32E) has a radial lug (62) pressed out to receive said electrical earth conductor (60) and bent back so as to hold said electrical earth conductor (60) in position with respect to the front disc.

2. A contactor (10) for a motor vehicle starter comprising a carcass (12) having a front end provided with a cylindrical seating (11), a coil (20) mounted within the carcass (12) and having a front axial end, a movable magnetic core (24) which is displaced axially under the effect of a magnetic field created by the coil (20), a fixed magnetic core (26) arranged at the front axial end of the coil (20) and having, on the one hand, a rear base portion (28) which is received axially in the coil (20) and which includes an axial through hole (44) for passage through it of a movable contact plunger (46), and, on the other hand, an annular front disc (30) which is assembled to the rear base portion (28) and which is mounted in the cylindrical seating (44) of the carcass (12), said front disc (30) consisting of a stack of laminations (32) having at least a rear endmost lamination (32) adjacent to the rear base portion (28) and a front endmost lamination (32E), wherein the front endmost lamination (32E) has at least two fingers (64) which extend axially forward, in that the contactor comprises an electronic circuit board (66) associated with said fingers (64) and comprising two through holes (68) arranged for the fingers (64) to pass through them so that said circuit board (66) is fixed to the endmost lamination (33) by means of said fingers (64).

3. A contactor (10) according to claim 2, wherein the circuit board (66) is soldered on the fingers (64) and in that the front most lamination (32E) is tinned so as to facilitate soldering of the electronic circuit board (66).

4. A contactor (10) for a motor vehicle starter comprising a carcass (12) having a front end provided with a cylindrical seating (11), a coil (20) mounted within the carcass (12) and having a front axial end, a movable magnetic core (24) which is displaced axially under the effect of a magnetic field created by the coil (20), a fixed magnetic core (26) arranged at the front axial end of the coil (20) and having, on the one hand, a rear base portion (28) which is received axially in the coil (20) and which includes an axial through hole (44) for passage through it of a movable contact plunger (46), and, on the other hand, an annular front disc (30) which is assembled to the rear base portion (28) and which is mounted in the cylindrical seating (11) of the carcass (12), said front disc (30) consisting of a stack of laminations (32) having at least a rear endmost lamination (32) adjacent to the rear base portion (28) and a front endmost lamination (32E), wherein the front endmost lamination (32E) has on its edge (72) at least three points (74) which extend radically outwards so as to penetrate the material of the cylindrical seating (11) of the carcass (12).

* * * * *